US005881345A

United States Patent [19]

Yamane et al.

[11] Patent Number: 5,881,345

[45] Date of Patent: Mar. 9, 1999

[54] IMAGE FORMING MACHINE

[75] Inventors: Naoki Yamane; Koji Shin, both of Osaka, Japan

[73] Assignee: Mita Industrial Company, Ltd., Osaka, Japan

[21] Appl. No.: 890,395

[22] Filed: Jul. 9, 1997

[30] Foreign Application Priority Data

Sep. 7, 1996 [JP] Japan ..... 8-178790

[51] Int. Cl.[6] ..... G03G 15/08

[52] U.S. Cl. ..... 399/255; 399/359

[58] Field of Search ..... 399/254, 255, 399/256, 358, 359, 360

[56] References Cited

U.S. PATENT DOCUMENTS 5,592,267 1/1997 Misago et al. ..... 399/359 X

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

An image forming machine, including an image bearing member, a developing unit for developing a latent electrostatic image on the image bearing member into a toner image, a cleaning unit for removing remaining toner from the image bearing member after transfer of the toner image from the image bearing member onto a sheet member, and a toner supply unit for supplying toner to the developing unit. The toner supply unit includes a first toner acceptance region where fresh toner is introduced, a second toner acceptance region where recycled toner, that has been removed from the image bearing member by the cleaning unit, is introduced, a toner discharge region having a toner discharge opening communicating with the developing unit, a first toner conveying member for conveying fresh toner from the first toner acceptance region to the toner discharge region, and a second toner conveying member for conveying recycled toner from the second toner acceptance region to the toner discharge region.

6 Claims, 5 Drawing Sheets

IMAGE FORMING MACHINE

FIELD OF THE INVENTION

This invention relates to a an image forming machine of the type in which a developing means, for developing a latent electrostatic image formed on an image bearing means into a toner image is equipped with a toner supply means for supplying to the developing means not only fresh toner, but also recycled toner that has been removed from the image bearing means.

DESCRIPTION OF THE PRIOR ART

In an electrostatic image forming machine, such as an electrostatic copier, a printer, or a facsimile machine, a latent electrostatic image is formed on an image bearing means, which may be a rotating drum having an electrostatic photoconductor disposed on the peripheral surface thereof. The latent electrostatic image on the image bearing means is developed to a toner image by a developing means. Then, the toner image on the image bearing means is transferred onto a sheet member, which may be a plain paper. Toner remaining on the image bearing means after transfer is removed from the image bearing means by a cleaning means.

The developing means applies developer containing toner onto the image bearing means to develop the latent electrostatic image on the image bearing means into a toner image. In the developing means, the toner is consumed as development proceeds, thus requiring that toner be supplied suitably to the developing means in the process of the development. Recently, as disclosed in Japanese Laid-Open Patent Publication No. 137561/80, it has been proposed to equip the developing means with a toner supply means for supplying the developing means not only with fresh toner, but also with recycled toner which has been removed from the image bearing means. An image forming machine with this type of toner supply means has found practical use.

In a conventional image forming machine, with a toner supply means for supplying a developing means not only with fresh toner but also with recycled toner removed from the image bearing means, the ratio between the fresh toner and the recycled toner in the toner supplied to the developing means is not controlled, thereby posing the following problems: The recycled toner, compared with the fresh toner, is deteriorated in at least some of its characteristics, such as charge characteristics. If the proportion of the recycled toner in the toner supplied to the developing means is too high, therefore, the quality of the toner image that is developed will be degraded, or the toner will excessively scatter in the developing zone. If the supply of the recycled toner to the developing means is overly restricted, the amount of the recycled toner that has been removed from the image bearing means, but has not been fed to the developing means, will become too large. As a result, there may be an overflow of the recycled toner from a recycled toner passageway or reservoir.

SUMMARY OF THE INVENTION

This invention has been made in the light of the foregoing facts. A principal object of the invention is to improve a toner supply means for supplying a developing means with recycled toner, removed from an image bearing means, along with fresh toner, thereby making-the ratio between fresh toner and recycled toner in the toner supplied to the developing means controllable in a desired range.

Another object of the invention is to attain the above object by a relatively simple construction without requiring a complicated, expensive structure.

To achieve the main object, the present invention disposes a toner supply means, of the type including a first toner acceptance region where fresh toner is introduced, a second toner acceptance region where recycled toner that has been removed from an image bearing means by a cleaning means is introduced, a toner discharge region where a toner discharge opening communicating with the developing means is formed, a first toner conveying means for conveying the fresh toner present in the first toner acceptance region to the toner discharge region, and a second toner conveying means for conveying the recycled toner present in the second toner acceptance region to the toner discharge region; wherein the ratio between the fresh toner and the recycled toner in the toner supplied to the developing means is defined by the amount of fresh toner conveyed by the first toner conveying means and the amount of recycled toner conveyed by the second toner conveying means.

That is, the present invention provides a image forming machine attaining the principal object, which is an image forming machine comprising an image bearing means, a latent electrostatic image forming means for forming a latent electrostatic image on the image bearing means, a developing means for developing the latent electrostatic image on the image bearing means to a toner image, a transfer means for transferring the toner image on the image bearing means onto a sheet member, a cleaning means for removing toner remaining on the image bearing means after transfer from the image bearing means, and a toner supply means for supplying toner to the developing means; wherein:

the toner supply means includes a first toner acceptance region where fresh toner is introduced, a second toner acceptance region where recycled toner that has been removed from the image bearing means by the cleaning means is introduced, a toner discharge region where a toner discharge opening communicating with the developing means is provided, a first toner conveying means for conveying fresh toner present in the first toner acceptance region to the toner discharge region, and a second toner conveying means for conveying recycled toner present in the second toner acceptance region to the toner discharge region, and the ratio between the fresh toner and the recycled toner in the toner supplied to the developing means is defined by the amount of fresh toner conveyed by the first toner conveying means and the amount of recycled toner conveyed by the second toner conveying means.

Preferably, a toner passageway, extending substantially linearly, is formed in the toner supply means, the toner discharge region is defined at an intermediate part of the toner passageway, the first toner conveying means conveys fresh toner from one end to the intermediate part of the toner passageway, and the second toner conveying means conveys recycled toner from the other end to the intermediate part of the toner passageway. Preferably, a rotating shaft extends across the toner passageway, a first spiral blade is formed at one side part of the rotating shaft, a second spiral blade is formed at the other side part of the rotating shaft, the first spiral blade and the second spiral blade are wound in opposite directions, and the first spiral blade constitutes the first toner conveying means, while the second spiral blade constitutes the second toner conveying means. In a preferred embodiment, the toner passageway has substantially the same cross-sectional area throughout its lengthwise dimension, the outside diameter of the first spiral blade and the outside diameter of the second spiral blade are substantially the same, and the ratio between the fresh toner and the recycled toner in the toner supplied to the developing means is defined by the ratio between the pitch of the first spiral blade and the pitch of the second spiral blade. The pitch of the first spiral blade and the pitch of the second spiral blade may be different from each other. In the toner supply means, it is preferred that there are formed a first toner acceptance chamber disposed along the one end of the toner passageway, and a second toner acceptance chamber disposed along the other end of the toner passageway. Preferably, the first toner acceptance chamber defines the first toner acceptance region, while the second toner acceptance chamber defines the second toner acceptance region. Preferably, the toner supply means includes a toner cartridge mounted detachably, and fresh toner in the toner cartridge is introduced into the first toner acceptance region.

DETAILED DESCRIPTION OF THE PREFERRED EMBODIMENTS

The present invention will now be described in detail with reference to the accompanying drawings illustrating preferred embodiments of an image forming machine constructed in accordance with the present invention.

Figure 1:
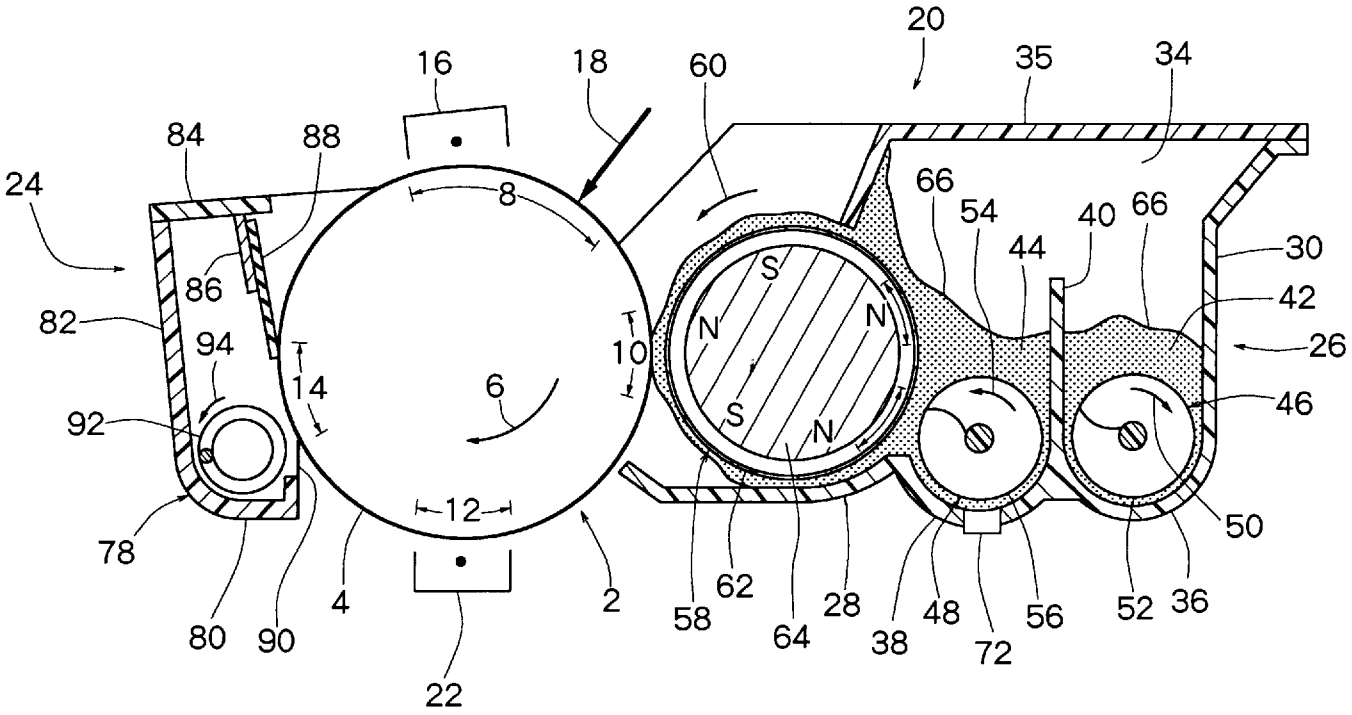
FIG. 1 is a schematic sectional view of main constituent elements in an image forming machine constructed in accordance with the present invention.

FIG. 1 briefly shows main constituent elements in an image forming machine constructed in accordance with the present invention. The illustrated image forming machine has a rotating drum 2 constituting an image bearing means. On the peripheral surface of the rotating drum 2, an electrostatic photoconductor 4 is disposed. Around the rotating drum 2, which is to be rotated in the direction of an arrow 6, a latent electrostatic image forming zone 8, a developing zone 10, a transfer zone 12, and a cleaning zone 14 are disposed in this order. In the latent electrostatic image forming zone 8, the surface of the electrostatic photoconductor 4 is uniformly charged to a specific polarity by the action of a charging corona discharger 16. Then, as diagrammatically indicated by an arrow 18, the electrostatic photoconductor 4 is exposed to light in accordance with an image to be formed, whereby a latent electrostatic image is formed on the electrostatic photoconductor 4. In the developing zone 10, a developer is applied onto the electrostatic photoconductor 4 by a developing means designated generally by the numeral 20, whereby the latent electrostatic image is developed to a toner image. In the transfer zone 12, the toner image on the electrostatic photoconductor 4 is transferred onto a sheet member (not shown) conveyed through the transfer zone 12. On this occasion, a discharge current for transfer is applied by a transfer corona discharger 22 to the back of the sheet member, which may be a plain paper. In the cleaning zone 14, toner remaining on the electrostatic photoconductor 4 after transfer is removed from the electrostatic photoconductor 4 by the action of a cleaning means indicated generally by the numeral 24.

With further reference to FIG. 1, the developing means 20 includes a development housing 26. The development housing 26 includes a bottom wall 28 and a side wall 30 that are formed integrally. The two in the front-to-back direction of the development housing 26 (the direction perpendicular to the sheet surface of FIG. 1) are closed by a front end wall 32 (see FIG. 2) and a rear end wall 34, respectively. Onto the top surface of the development housing 26, a cover member 35 is joined. On the bottom wall 28, two arcuate portions 36 and 38 are formed. Between the arcuate portions 36 and 38, a substantially vertically upwardly extending partition wall 40 is formed. In the development housing 26, the partition wall 40 separates a first developer passageway 42, situated on one side of the partition wall 40, and a second developer passageway 44, situated on the other side of the partition wall 40. The first developer passageway 42 and the second developer passageway 44 extend in the direction perpendicular to the sheet surface of FIG. 1. The partition wall 40 does not exist in the opposite ends in the front-to-back direction of the development housing 26, so that the first developer passageway 42 and the second developer passageway 44 communicate with each other at the front and rear ends of the development housing 26. In the first developer passageway 42, a first developer conveying means 46 is disposed, and in the second developer passageway 44, a second developer conveying means 48 is disposed. The first developer conveying means 46 includes a spiral blade 52 rotationally driven in the direction of an arrow 50, while the second developer conveying means 48 includes a spiral blade 56 rotationally driven in the direction of an arrow 54. In a left end in FIG. 1 of the development housing 26, a developer applicator means 58 is disposed. This developer applicator means 58 is composed of a rotating sleeve member 62 which is rotationally driven in the direction of an arrow 60, and a stationary permanent magnet member 64 placed in the sleeve member 62. A part of the developer applicator means 58 protrudes outward through an opening formed between the bottom wall 28 and the cover member 35. A free terminal edge of the cover member 35 is located in proximity to the outer peripheral surface of the sleeve member 62 to serve as a regulating means for regulating the thickness of a layer 66 of developer which is held on the outer peripheral surface of the sleeve member 62 and conveyed to the developing zone 10. As will be seen by reference to FIG. 2 along with FIG. 1, the arcuate portions 36 and 38 of the bottom wall 28, and the side wall 30 extend outward of an upright support base plate 100 (to the lower left in FIG. 2). An additional side wall (not shown) extending upward from one side edge of the arcuate portion 38 (the left side edge in FIG. 1) is formed integrally with the above protrusions. Onto the top surface of the protrusions, an additional cover member 68 is joined. In the additional cover member 68, a toner introduction opening 70 is formed. The first developer passageway 42 and the second developer passageway 44 extend into the protrusions, and the toner introduction opening 70 is positioned above the front end of the second developer passageway 44. As shown clearly in FIG. 1, an opening is formed in the arcuate portion 38 in the bottom wall 28 of the development housing 26. This opening is fitted with a toner concentration detector 72. The toner concentration detector 72 may be of a well known type which detects the permeability of the developer 66.

In the developing means 20 as described above, a required amount of developer 66 is accommodated in the development housing 26. The developer 66 contains carrier particles together with a toner. When the first developer conveying means 46 and the second developer conveying means 48 are rotationally driven, the developer 66 accommodated in the development housing 26 is conveyed rearward in the first developer passageway 42 as shown by an arrow 74 in FIG. 2, and moved from the first developer passageway 42 to the second developer passageway 44 at the rear end of the development housing. Then, as shown by an arrow 76 in FIG. 2, the developer 66 is conveyed forward in the second developer passageway 44, and moved from the second developer passageway 44 to the first developer passageway 42 at the front end of the development housing 26. During conveyance of the developer 66 through the first developer passageway 42 and the second developer passageway 44, the toner and carrier particles are agitated and mixed, whereupon the toner is charged to a specific polarity. The developer applicator means 58 holds the developer 66 on the sleeve member 62 by the action of a magnetic field generated by the stationary permanent magnet member 64. The developer 66 held on the sleeve member 62 is conveyed to the developing zone 10 in accordance with the rotation of the sleeve member 62, and is applied to the electrostatic photoconductor 4 disposed on the peripheral surface of the rotating drum 2. Thus, the latent electrostatic image on the electrostatic photoconductor 4 is developed to a toner image. As development proceeds, toner is consumed. When the toner concentration in the developer 66 becomes less than a predetermined value, the toner concentration detector 72 detects this. At this time, a toner supply means, to be described in detail later on, is actuated to supply toner into the development housing 26 through the toner introduction opening 70.

Referring to FIG. 1, cleaning means 24 includes a cleaning housing 78. The cleaning housing 78 includes a bottom wall 80 and a side wall 82 that are formed integrally. Both ends in the front-to-back direction of the cleaning housing 78 (the direction perpendicular to the sheet surface of FIG. 1) are closed by a front end wall and a rear end wall (not shown), respectively. Onto the top surface of the cleaning housing 78, a cover member 84 is joined. In the cover member 84, a protruding piece 86 is disposed which inclines slightly rightward and protrudes downward. To this protruding piece 86, an upper end of a cleaning blade 88 is fixed. A free end of the cleaning blade 88, which may be formed of synthetic rubber, is pressed against the electrostatic photoconductor 4 on the rotating drum 2. To a front terminal edge of the bottom wall 80 of the cleaning housing 78, i.e., the right terminal edge in FIG. 1, a lower end part of a seal piece 90, optionally formed of a plastic film, is fixed. This seal piece 90 extends upward, and its free end is brought into contact with the electrostatic photoconductor 4 on the rotating drum 2. In a lower part of the cleaning housing 78, a toner discharge means 92 is disposed. This toner discharge means 92 is composed of a spiral coil extending in the front-to-back direction. As will be mentioned further later on, the toner discharge means 92 extends forward through a discharge opening (not shown) formed in a front end wall (not shown) of the cleaning housing 78. The toner discharge means 92 is rotationally driven in the direction of an arrow 94.

In the above-described cleaning means 24, the free end of the cleaning blade 88 acts on the electrostatic photoconductor 4 on the rotating drum 2 which is rotated in the direction of arrow 6, thereby scraping the remaining toner off the electrostatic photoconductor 4. The seal piece 90 prevents the scraped-off toner from scattering downward, out of the cleaning housing 78. The fallen toner is collected in the lower part of the cleaning housing 78. The toner discharge means 92, rotationally driven in the direction of arrow 94, conveys the toner forward, discharges it from the cleaning housing 78 through the discharge opening formed in the front end wall of the cleaning housing 78, and introduces it into a second toner acceptance chamber in a toner supply means (to be described later on).

Figure 2:
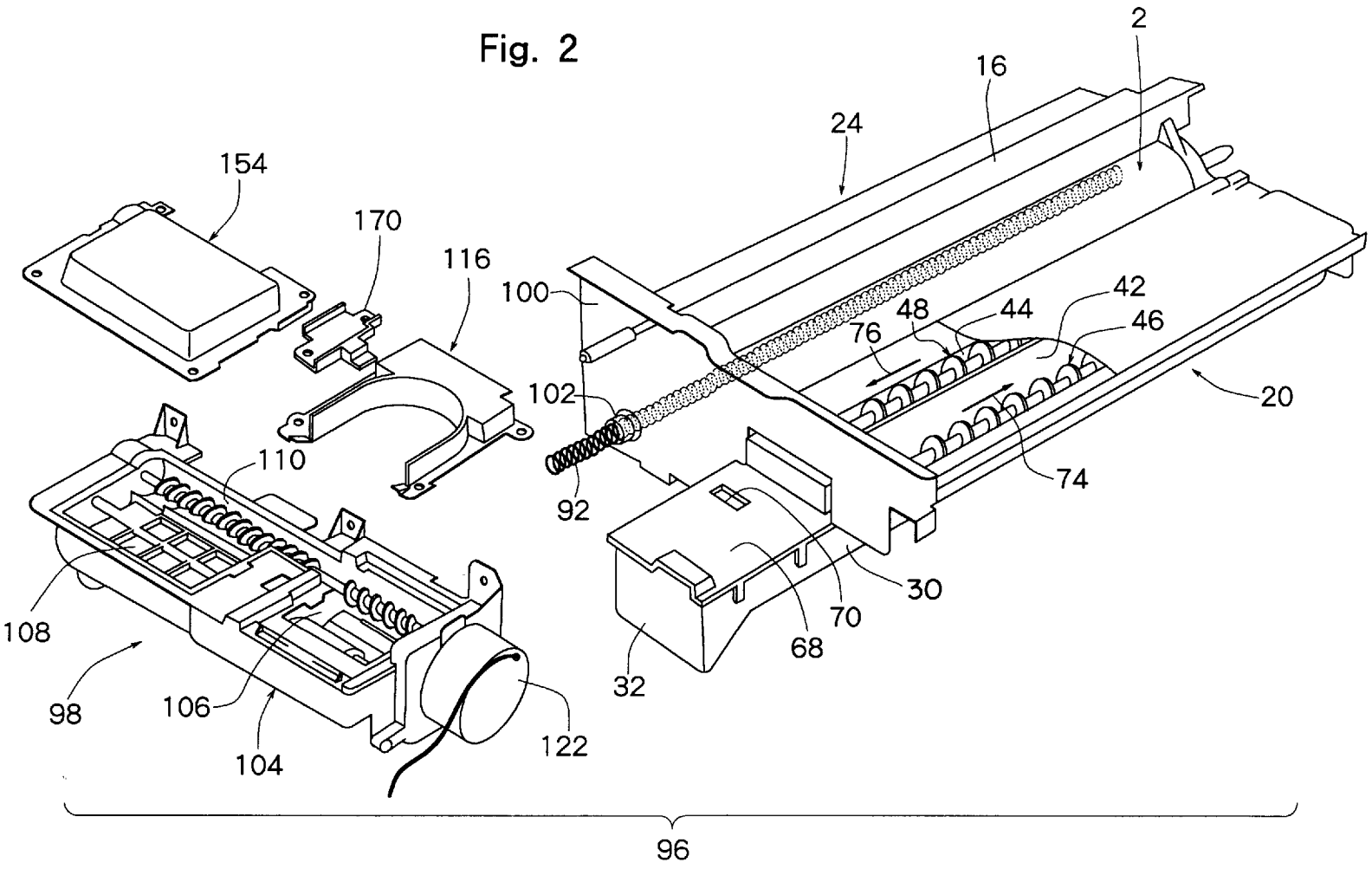
FIG. 2 is an exploded perspective view of the main constituent elements in the image forming machine as shown in FIG. 1.

As will be seen by reference to FIG. 2 along with FIG. 1, the rotating drum 2, charging corona discharger 16, developing means 20 and cleaning means 24 are combined as required, making up one unit 96. Such a unit 96 is mounted at a predetermined position of a main housing (not shown) of an image forming machine. The transfer corona discharger 22 illustrated in FIG. 1 is mounted at a required position of the main housing separately from the unit 96.

The above-described constitution of the illustrated image forming machine may be of a known type and does not constitute a novel feature in an image forming machine improved in accordance with the present invention. Thus, a more detailed description of the above constitution of the illustrated image forming machine is omitted in the present specification.

With further reference to FIG. 2, the unit 96 also has a toner supply means, indicated generally by the numeral 98 and improved in accordance with the present invention. As clearly shown in FIG. 2, the unit 96 includes an upright support base plate 100, and the rotating drum 2 is mounted on the rear side of the support base plate 100. The arcuate portions 36 and 38 of the bottom wall 20, as well as the side wall 30, in the developing means 20 protrude forward through a cutout formed in the support base plate 100. The toner discharge means 92 in the cleaning means 24 extends forward through a short cylindrical body 102 extending through the support base plate 100. The toner supply means 98 is situated on the front side of the support base plate 100.

Figure 3:
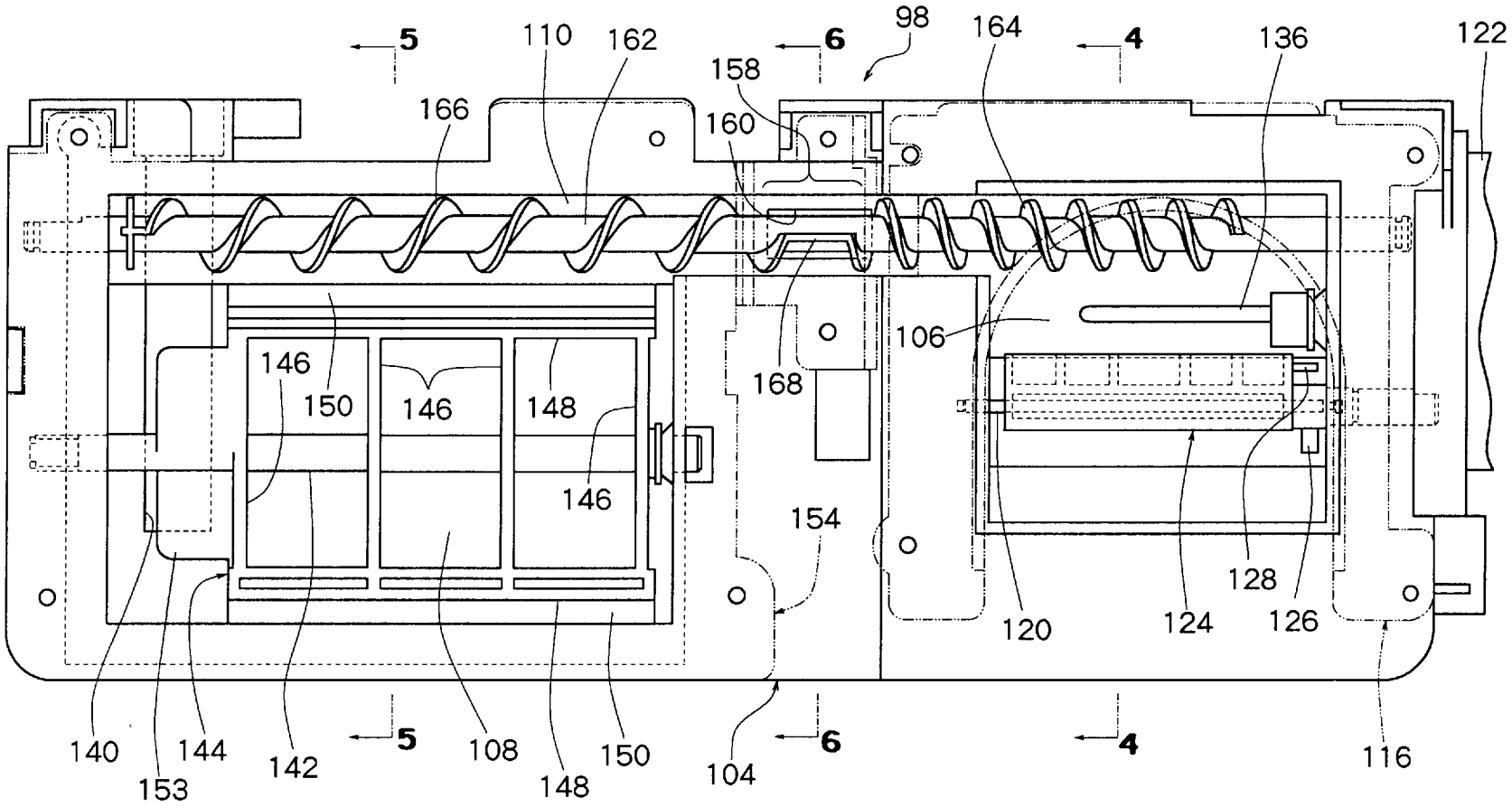
FIG. 3 is a plan view of a toner supply means in the image forming machine shown in FIG. 1.

Referring to FIGS. 2 and 3, the illustrated toner supply means 98 improved in accordance with the present invention includes a case 104, which may be formed of a suitable plastic material. The case 104 is fixed to the support base plate 100. In the case 104, a first toner acceptance chamber 106, a second toner acceptance chamber 108, and a toner passageway 110 are formed. The first toner acceptance chamber 106 and the second toner acceptance chamber 108 are arranged in parallel. The toner passageway 110 extends linearly at the rear of the case 104, one end of the toner passageway 110 extends adjacent the first toner acceptance chamber 106, and the other end of the toner passageway 110 extends adjacent the second toner acceptance chamber 108.

Figure 4:
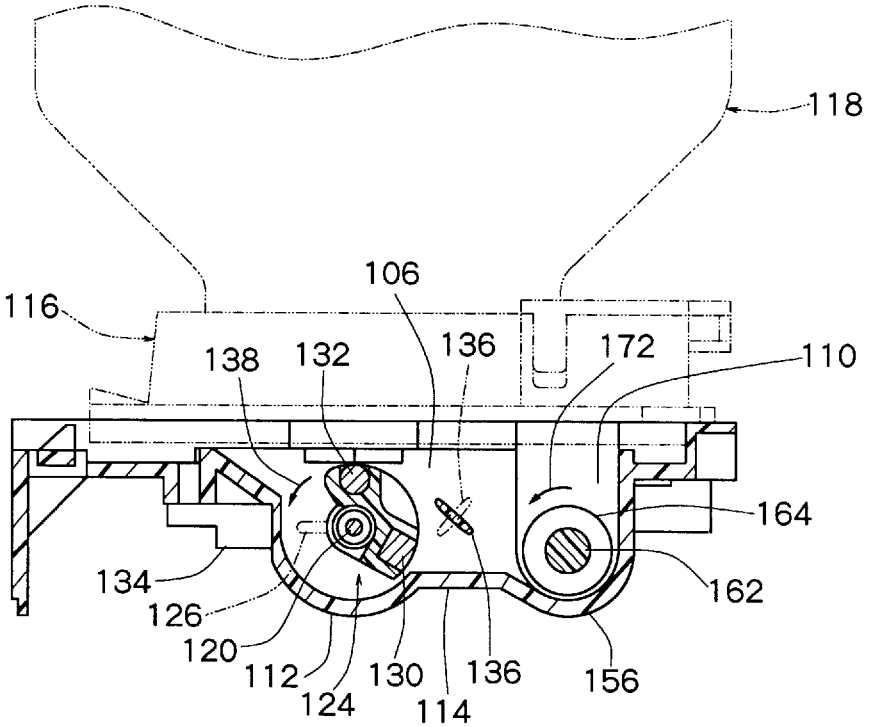
FIG. 4 is a sectional view taken along line 4—4 of FIG. 3.

A reference to FIG. 4 along with FIGS. 2 and 3 shows that the first toner acceptance chamber 106 is relatively shallow. Its bottom wall, when viewed cross sectionally, has a nearly arcuately curved portion 112 and a substantially horizontally extending portion 114. The rear of the first toner acceptance chamber 106 (to the right in FIG. 4) directly communicates with one end of the toner passageway 110. Such first toner acceptance chamber 106 defines a first toner acceptance region where fresh toner is introduced. On the case 104, a toner cartridge mounting frame 116 is mounted to lie above the first toner acceptance chamber 106. This frame 116 is of a nearly U-shape. On the frame 116, a toner cartridge 118 (FIG. 4) is mounted detachably. After the toner cartridge 118 is mounted on the frame 116, a discharge port formed in the lower end surface of the toner cartridge 118 is unsealed.

Thus, fresh toner accommodated in the toner cartridge 118 is discharged into the first toner acceptance chamber 106. The frame 116 and the toner cartridge 118 may themselves be of well known types, and so a detailed explanation for them is omitted herein.

Further referring to FIGS. 2 to 4, a rotating shaft 120 extending substantially horizontally above the arcuate portion 112 of the bottom wall is mounted in the first toner acceptance chamber 106. This rotating shaft 120 is drivingly connected via a suitable transmission element (not shown) to an electric motor 122, which is mounted on one side surface of the case 104. On the rotating shaft 120, a moving member 124 of a nearly fan-shaped cross section is mounted for rotation. At one end of the rotating shaft 120, a protruding piece 126 protrudes radially. On the other hand, a protruding piece 128 protrudes in the axial direction from one end surface in the axial direction of the moving member 124. The position in the axial direction of the protruding piece 126 of the rotating shaft 120 is aligned with the position in the axial direction of the protruding piece 128 of the moving member 124. At one side in the circumferential direction of the moving member 124, a weight 130 is disposed. At another side in the circumferential direction of the moving member 124, a permanent magnet 132 is disposed. On the front wall of the first toner acceptance chamber 106, a magnetic sensor 134 is disposed. In the first toner acceptance chamber 106, moreover, an elongated strip 136 extends in the axial direction above the horizontal portion 114 of the bottom wall and is mounted so as to be free to turn in a reciprocating manner between a first angular position indicated by a solid line and a second angular position indicated by a two-dot chain line in FIG. 4. This strip 136 is also drivingly connected to the electric motor 122 via a suitable transmission element (not shown).

As will be further described later on, the electric motor 122 is energized, when the toner concentration detector 72 detects that the toner concentration in the developer 66 present in the development housing 26 of the developing means 20 has dropped below a predetermined value. Thus, the rotating shaft 120 is rotated in the direction of an arrow 138, and the strip 136 is caused to turn in a reciprocating manner between the first angular position and the second angular position. The protruding piece 126 of the rotating shaft 120 contacts the protruding piece 128 of the moving member 124. When the rotating shaft 120 is rotated in the direction of the arrow 138, therefore, the moving member 124 is also rotated in the direction of arrow 138. As seen by reference to FIG. 4, when the moving member 124 is rotated in the direction of arrow 138, the toner present on the arcuate portion 112 of the bottom wall is moved by the moving member 124 to the horizontal portion 114 of the bottom wall. The strip 136, which is caused to turn in a reciprocating manner between the first and second angular positions, prevents the toner from solidifying in a lump on the horizontal portion 114 of the bottom wall. The strip 136 also moves the toner present on the horizontal portion 114 of the bottom wall into one side part of the toner passageway 110, when the strip 136 is turned between the first angular position and the second angular position. When the toner concentration in the development housing 26 detected by the toner concentration detector 72 rises above a predetermined value, the electric motor 122 is deenergized at a time when the rotating shaft 120 comes to the angular position illustrated in FIG. 4. When a sufficient amount of toner exists in the first toner acceptance chamber 106, especially on the arcuate portion 112 of the bottom wall, the toner resists the rotation of the moving member 124. Thus, the moving member 124 is rotated at a nearly constant rotational speed in accordance with the rotation of the rotating shaft 120. As a result, the magnet 132 disposed, at another side in the circumferential direction of the moving member 124, passes by the magnetic sensor 134 at a nearly constant rotational speed. When the toner in the toner cartridge 118 is substantially used up, and a sufficient amount of toner is not present on the arcuate portion 112 of the bottom wall, on the other hand, the resistance provided by the toner to the rotation of the moving member 124 decreases. In this case, the moving member 124 is rotated through about 120 degrees from the angular position shown in FIG. 4 in accordance with the rotation of the rotating shaft 120. When the weight 130 disposed on the moving member 124 goes beyond its uppermost position, the moving member 124 is rotated rapidly to the position indicated by the solid line in FIG. 4, because the center of gravity of the moving member 124 is eccentric owing to the weight 130. As a result, the magnet 132, disposed at the other side in the circumferential direction of the moving member 124, passes by the magnetic sensor 134 at a high rotational speed. Consequently, the time interval from the time when the electric motor 122 is energized until the time when the magnetic sensor 134 detects the magnet 132 becomes relatively short. The toner supply means 98 is provided with a time measuring means (not shown) for measuring the time interval from the time when the electric motor 122 is energized until the time when the magnetic sensor 134 detects the magnet 132. When this time interval falls short of a predetermined value, a signal is produced. Once this signal is produced, a lamp (not shown) is lit for showing that the toner cartridge 118 should be replaced by a fresh one.

Figure 5:
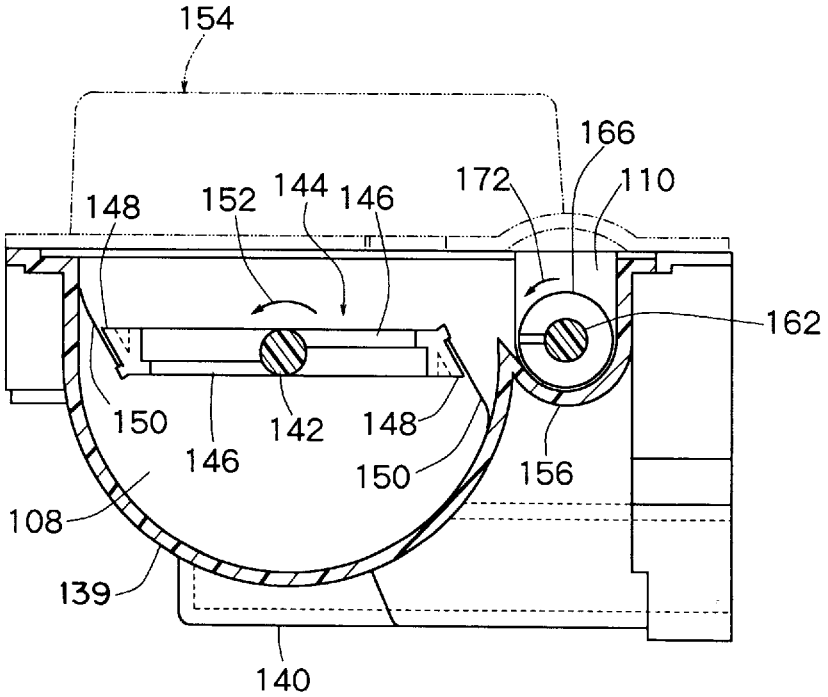
FIG. 5 is a sectional view taken along line 5—5 of FIG. 3.

A reference to FIG. 5 along with FIGS. 2 and 3 shows that the second toner acceptance chamber 108 is relatively shallow and has a bottom wall 139 which, in a cross sectional view, has a nearly semicircular shape. The rear of the second toner acceptance chamber 106 (to the right in FIG. 5) communicates with the second end of the toner passageway 110. Such second toner acceptance chamber 108 defines a second toner acceptance region where recycled toner discharged from the cleaning means 24 is introduced. As is seen by reference to FIGS. 3 and 5, the second toner acceptance chamber 108 is provided with a cylindrical portion 140 which protrudes substantially horizontally rearward (upward in FIG. 3, rightward in FIG. 5) from a lower part of one side portion of the chamber 108. In this cylindrical portion 140, a recycled toner introduction passage communicating with the second toner acceptance chamber 108 is defined. The front end of the short cylindrical body 102 which is disposed in the support base plate 100 is inserted into the cylindrical portion 140. Thus, the cleaning housing 78 of the cleaning means 24 communicates with the second toner acceptance chamber 108 via the short cylindrical body 102 and the cylindrical portion 140. With reference to FIG. 1 as well, a front end of the toner discharge means 92, which is disposed in the cleaning means 24 extends into the cylindrical portion 140 after passing through the short cylindrical body 102. When the toner discharge means 92 is rotationally driven in the direction of arrow 94 in FIG. 1, therefore, the toner in the cleaning housing 78 is discharged from the cleaning housing 78 and is introduced into the second toner acceptance chamber 108 via the short cylindrical body 102 and the cylindrical portion 140.

Further referring to FIGS. 2, 3 and 5, a rotating shaft 142 extends substantially horizontally in the second toner acceptance chamber 108. This rotating shaft 142 is drivingly connected to the electric motor 122 via a suitable transmission element. (Such a transmission element includes a rotating shaft disposed in the toner passageway 110 and described later on.). On the rotating shaft 142, a moving member 144 is formed integrally. The moving member 144 has four ribs 146 extending diametrically with spacing in the axial direction. Ribs 148 are connected to the two protruding ends of each of the four ribs 146 and extend in the axial direction. To each of the ribs 148, a plastic film piece 150 is fixed. Each of the film pieces 150 extends from the rib 148 radially outward so as to be inclined in a direction opposite to the direction of rotation of the rotating shaft 142, which is indicated by an arrow 152. The moving member 144 further includes a plate-like piece 153 extending diametrically from one end of the rotating shaft 142. The inward edge in the axial direction of the plate-like piece 153 is connected to one of the four ribs 148. The plate-like piece 153 is situated above the cylindrical portion 140. The top surface of the second toner acceptance chamber 108 is closed with a cover member 154 mounted on the top surface of the case 104.

As stated previously, recycled toner discharged from the cleaning housing 78 of the cleaning means 24 is introduced into the second toner acceptance chamber 108. When the electric motor 122 is energized, the rotating shaft 142 is rotationally driven in the direction of arrow 152. Thus, the front edge of the film piece 150 rubs the bottom wall 138 to move the recycled toner present in the second toner acceptance chamber 108 into the toner passageway 110. The plate-like piece 153 of the moving member 144 lifts the recycled toner introduced into the bottom part of the second toner acceptance chamber 108 through the cylindrical portion 140.

Figure 6:
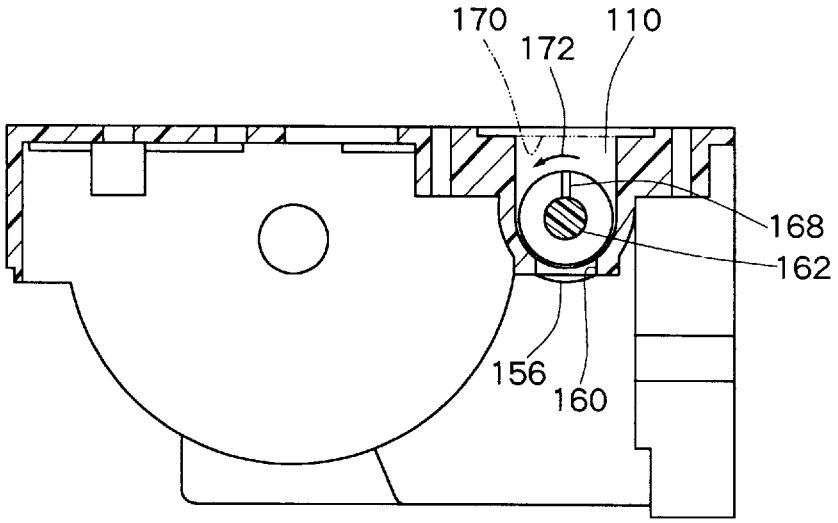
FIG. 6 is a sectional view taken along line 6—6 of FIG. 3.

A reference to FIG. 6 along with FIGS. 2 and 3 shows that the toner passageway 110 is relatively shallow and has a bottom wall 156 (see FIGS. 4 and 5) which, in a cross sectional view, has a nearly semicircular shape. The linearly extending toner passageway 110 includes an intermediate portion 158 (FIG. 3) lying between one end thereof extending along the first toner acceptance chamber 106 and the other end thereof extending along the second toner acceptance chamber 108. This intermediate portion 158 defines a toner discharge region. In the intermediate portion 158, a toner discharge opening 160 is formed in the bottom wall 156. The toner discharge opening 160 is aligned with and positioned above the toner introduction opening 70 (FIG. 2) of the developing means 20.

In the toner passageway 110, a rotating shaft 162 extends substantially horizontally. The rotating shaft 162 is drivingly connected to the electric motor 122 via a suitable transmission element (not shown). The rotating shaft 142 disposed in the second toner acceptance chamber 108 is drivingly connected to the rotating shaft 162 via a suitable transmission element (not shown). Thus, the rotating shaft 142 may be drivingly connected to the electric motor 122 via the rotating shaft 162. On one end of the rotating shaft 162, namely, the end extending along the first toner acceptance chamber 106, a first spiral blade 164 is disposed. On the other end of the rotating shaft 162, namely, the end extending along the second toner acceptance chamber 108, a second spiral blade 166 is disposed. In the illustrated embodiment, the outside diameter of the first spiral blade 164 and the outside diameter of the second spiral blade 166 are substantially the same. However, the pitch Pa of the first spiral blade 164 and the pitch Pb of the second spiral blade 166 are different from each other, the pitches being set as Pb=2Pa. On an intermediate part of the rotating shaft 162, i.e., the part located at the intermediate portion 158 of the toner passageway 110, a paddle 168 is disposed. Paddle 168 is a plate-like piece protruding in the radial direction. The top surface of that one end of the toner passageway 110 which extends along the first toner acceptance chamber 106 is closed by the frame 116. The top surface of the other end of the toner passageway 110 which extends along the second toner acceptance chamber 108 is closed by the cover member 154. The top surface of the intermediate portion 158 of the toner passageway 110, which defines the toner discharge region, is closed by a cover member 170 mounted on the top surface of the case 104.

When the electric motor 122 is energized, the rotating shaft 162 is rotationally driven in the direction of an arrow 172. Thus, the toner moved from the first toner acceptance chamber 106 to the one side part of the toner passageway 110 (such toner is fresh toner introduced from the toner cartridge 118 into the first toner acceptance chamber 106) is conveyed to the intermediate portion 158 of the toner passageway 110 by the conveying action of the first spiral blade 164. Simultaneously, the toner moved from the second toner acceptance chamber 108 to the other end of the toner passageway 110 (such toner is recycled toner introduced from the cleaning means 24 into the second toner acceptance chamber 108) is conveyed to the intermediate portion 158 of the toner passageway 110 by the conveying action of the second spiral blade 166. Hence, the first spiral blade 164 constitutes a first toner conveying means for conveying fresh toner, introduced into the first toner acceptance chamber 106, to the toner discharge region defined by the intermediate portion 158 of the toner passageway 110. Whereas the second spiral blade 166 constitutes a second toner conveying means for conveying recycled toner, introduced into the second toner acceptance chamber 108, to the toner discharge region defined by the intermediate portion 158 of the toner passageway 110. The fresh toner conveyed to the toner discharge region by the first spiral blade 164 and the recycle toner conveyed to the toner discharge region by the second spiral blade 166 are mixed together in the toner discharge region, discharged through the toner discharge opening 160, and supplied to the developing means 20 through the toner introduction opening 70 (FIG. 2). The paddle 168 disposed on the rotating shaft 162 moves the toner, conveyed to the toner discharge region, toward the toner discharge opening 160, promoting the discharge of the toner through the toner discharge opening 160.

The action of the toner supply means 98 will be summarized as follows: When the toner concentration detector 72 detects that the toner concentration in the developer 66 present in the development housing 26 has fallen below a predetermined value, the electric motor 122 is energized. Thus, the rotating shaft 162 is rotationally driven in the direction of arrow 172, and fresh toner present in the one end of the toner passageway 110 is conveyed to the toner discharge region by the first spiral blade 164. At the same time, recycled toner present in the other end of the toner passageway 110 is conveyed to the toner discharge region by the second spiral blade 166. This fresh toner and recycled toner are mixed together and supplied to the development housing 26 through the toner discharge opening 160 and the toner introduction opening 70. Simultaneously, fresh toner present in the first toner acceptance chamber 106 is moved to the one end of the toner passageway 110 by the moving member 124, which is rotated in the direction of arrow 138, and the strip 136 is turned in a reciprocating manner. On the other hand, recycled toner present in the second toner acceptance chamber 108 is moved to the other end of the toner passageway 110 by the moving member 144 which is rotated in the direction of arrow 152.

Assume that a sufficient amount of fresh toner is present in the first toner acceptance chamber 106, and a sufficient amount of fresh toner is moved to the one end of the toner passageway 110, while a sufficient amount of recycled toner is present in the second toner acceptance chamber 108, and a sufficient amount of recycled toner is moved to the other end of the toner passageway 110. As long as these conditions are fulfilled, the ratio between fresh toner and recycled toner in the toner discharged through the toner discharge opening 160, and thus the toner introduced into the developing means 20 through the toner introduction opening 70, is defined by the amount of fresh toner conveyed to the toner discharge region by the first spiral blade 164 and the amount of recycled toner conveyed to the toner discharge region by the second spiral blade 166. In the illustrated embodiment, the first spiral blade 164 and the second spiral blade 166 are disposed on the common rotating shaft 162, so that the number of revolutions of the first spiral blade 164 and the number of revolutions of the second spiral blade 166 are the same. As mentioned previously, the outside diameter of the first spiral blade 164 and the outside diameter of the second spiral blade 166 are also substantially the same. Thus, the ratio between the amount of conveyance by the first spiral blade 164 and the amount of conveyance by the second spiral blade 166 is defined by the pitch Pa of the first spiral blade 164 and the pitch Pb of the second spiral blade 166. This ratio is 1:2. That is, in the illustrated embodiment, the ratio between fresh toner and recycled toner in the toner supplied to the developing means 20 is 1:2. This ratio between fresh toner and recycled toner in the toner supplied to the developing means 20 can be suitably set depending on the volume of the second toner acceptance chamber 108 where recycled toner is introduced, the quality of development by the developing means 20, and so on. If the proportion of recycled toner in the toner supplied to the developing means 20 is decreased excessively, unacceptable performance will occur, in that toner will overflow from the second toner acceptance chamber 108, the cleaning housing 78 (FIG. 1), or the short cylindrical body 102 and cylindrical portion 140 which connect together the cleaning housing 78 and the second toner acceptance chamber 108. If the proportion of recycled toner in the toner supplied to the developing means 20 is increased excessively, on the other hand, the quality of development by the developing means 20 will overly decline. In the illustrated embodiment, the first spiral blade 164 and the second spiral blade 166 are disposed on common rotating shaft 162. If desired, however, the first spiral blade 164 and the second spiral blade 166 may be disposed on separate rotating shafts. In this case, the numbers of revolutions of the respective rotating shafts may be set suitably to adjust the ratio between the amount of fresh toner conveyed by the first spiral blade 164 and the amount of recycled toner conveyed by the second spiral blade 166.

The preferred embodiments of the image forming machine constructed in accordance with the present invention have been described in detail by reference to the accompanying drawings. It is to be understood, however, that the present invention is in no way restricted to these embodiments, and various changes and modifications may be made without departing from the spirit and scope of the invention.

What we claim is:

1. An image forming machine comprising image bearing means, latent electrostatic image forming means for forming a latent electrostatic image on the image bearing means, developing means for developing the latent electrostatic image on the image bearing means to a toner image, transfer means for transferring the toner image on the image bearing means onto a sheet member, cleaning means for removing toner, remaining on the image bearing means after transfer, from the image bearing means, and toner supply means for supplying toner to the developing means; wherein:

the toner supply means includes means defining a substantially linearly extending toner passageway, means defining a first toner acceptance region at a first end of the toner passageway into which fresh toner is introduced, means defining a second toner acceptance region at a second end of the toner passageway into which recycled toner, that has been removed from the image bearing means by the cleaning means, is introduced, means defining a toner discharge region at an intermediate point in the discharge passageway and having a toner discharge opening communicating with the developing means, a first toner conveying means for conveying fresh toner from the first toner acceptance region to the toner discharge region, and a second toner conveying means for conveying recycled toner from the second toner acceptance region to the toner discharge region.

2. The image forming machine of claim 1, wherein:

the toner supply means further includes a rotating shaft extending across the toner passageway;

the first toner conveying means comprises a first spiral blade formed on a first end of the rotating shaft, the second toner conveying means comprises a second spiral blade formed on a second end of the rotating shaft, and the first spiral blade and the second spiral blade are wound in opposite directions.

3. The image forming machine of claim 2, wherein:

the toner passageway has substantially the same cross-sectional area throughout its lengthwise dimension, the outside diameter of the first spiral blade and the outside diameter of the second spiral blade are substantially the same, and the ratio between the pitch of the first spiral blade and the pitch of the second spiral blade defines the ratio between the fresh toner and the recycled toner supplied to the developing means.

4. The image forming machine of claim 3, wherein the pitch of the first spiral blade and the pitch of the second spiral blade are different from each other.

5. The image forming machine of claim 1, wherein the first toner acceptance region comprises a first toner acceptance chamber disposed along the first end of the toner passageway, and the second toner acceptance region comprises a second toner acceptance chamber disposed along the second end of the toner passageway.

6. The image forming machine of claim 1, wherein the toner supply means further includes a detachably mounted toner cartridge for introducing fresh toner into the first toner acceptance region.

* * * * *